US006422842B2

(12) United States Patent
Sheridan et al.

(10) Patent No.: US 6,422,842 B2
(45) Date of Patent: Jul. 23, 2002

(54) SCROLL COMPRESSOR DISCHARGE MUFFLER

(75) Inventors: John P. Sheridan, Tipp City; Jeffrey W. Hirsch, Troy, both of OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/738,621

(22) Filed: Dec. 15, 2000

Related U.S. Application Data

(62) Division of application No. 09/348,964, filed on Jul. 7, 1999.

(51) Int. Cl.[7] ..... F01C 1/02
(52) U.S. Cl. ..... 418/55.1; 418/181
(58) Field of Search ..... 418/181, 55.1

(56) References Cited

U.S. PATENT DOCUMENTS

| | | | | |
|---|---|---|---|---|
| 3,880,245 A | * | 4/1975 | Anderson, Jr. | 181/33 |
| 4,389,171 A | | 6/1983 | Eber er al. | |
| 4,497,615 A | | 2/1985 | Griffith | |
| 4,609,334 A | | 9/1986 | Muir et al. | |
| 4,767,293 A | | 8/1988 | Caillat et al. | |
| 4,838,773 A | | 6/1989 | Noburu | |
| 4,848,513 A | * | 7/1989 | Csaszar | 181/265 |
| 4,877,382 A | | 10/1989 | Caillat et al. | |
| 4,904,165 A | * | 2/1990 | Fraser, Jr. et al. | 418/55.1 |
| 4,911,620 A | | 3/1990 | Richardson, Jr. et al. | |
| 4,929,160 A | | 5/1990 | Inoue | |
| 4,938,669 A | | 7/1990 | Fraser, Jr. et al. | |
| 5,071,323 A | | 12/1991 | Sakashita et al. | |
| 5,141,407 A | | 8/1992 | Ramsey et al. | |
| 5,141,420 A | | 8/1992 | Nambiar | |
| 5,156,539 A | | 10/1992 | Anderson et al. | |
| 5,197,868 A | | 3/1993 | Caillat et al. | |
| 5,200,872 A | | 4/1993 | D'Entremont et al. | |
| 5,219,281 A | | 6/1993 | Caillat et al. | |
| 5,247,736 A | | 9/1993 | Fraser, Jr. et al. | |
| 5,320,506 A | | 6/1994 | Fogt | |
| 5,342,183 A | * | 8/1994 | Rafalovich et al. | 418/55.1 |
| 5,358,391 A | * | 10/1994 | Wallis et al. | 418/55.1 |
| 5,368,446 A | | 11/1994 | Rode | |
| 5,427,511 A | | 6/1995 | Caillat et al. | |
| 5,482,450 A | | 1/1996 | Caillat et al. | |
| 5,487,654 A | | 1/1996 | Wallis et al. | |
| 5,527,167 A | | 6/1996 | Blass et al. | |
| 5,545,019 A | | 8/1996 | Beck et al. | |
| 5,582,511 A | | 12/1996 | Fairbanks | |
| 5,591,014 A | | 1/1997 | Wallis et al. | |
| 5,611,674 A | | 3/1997 | Blass et al. | |
| 5,649,816 A | * | 7/1997 | Wallis et al. | 418/55.1 |
| 5,667,371 A | | 9/1997 | Prenger et al. | |
| 5,674,061 A | | 10/1997 | Motegi et al. | |
| 5,731,556 A | * | 3/1998 | Gardner et al. | 181/230 |
| 5,741,120 A | | 4/1998 | Bass et al | |
| 5,800,141 A | | 9/1998 | Ceylan et al. | |
| 6,220,839 B1 | * | 4/2001 | Sheridan et al. | 418/55.1 |

FOREIGN PATENT DOCUMENTS

| | | |
|---|---|---|
| JP | 61-205386 | 9/1986 |
| JP | 63-173882 | 7/1988 |
| JP | 63-173884 | 7/1988 |
| JP | 63-239390 | 10/1988 |
| JP | 64-08389 | 1/1989 |
| JP | 01-032093 | 2/1989 |
| JP | 3-149380 | 6/1991 |
| JP | 5-079477 | 3/1993 |
| JP | 6-058281 | 3/1994 |
| JP | 7-035054 | 2/1995 |
| JP | 11-173284 | 6/1999 |
| JP | 11-182463 | 7/1999 |

* cited by examiner

*Primary Examiner*—Thomas Denion
*Assistant Examiner*—Theresa Trieu
(74) *Attorney, Agent, or Firm*—Harness, Dickey & Pierce, P.L.C.

(57) ABSTRACT

A scroll machine is provided with a muffler mounted to the fixed scroll of the scroll machine for improved sound attenuation.

10 Claims, 4 Drawing Sheets

SCROLL COMPRESSOR DISCHARGE MUFFLER

CROSS-REFERENCE TO RELATED APPLICATIONS

This is a divisional application of U.S. Ser. No. 09/348,964 filed Jul. 7, 1999.

FIELD OF THE INVENTION

The present invention relates generally to scroll-type machines. More particularly, the present invention relates to a scroll-type compressor incorporating a muffler assembly mounted to the non-orbiting scroll within the discharge chamber of the compressor.

BACKGROUND AND SUMMARY OF THE INVENTION

Scroll machines in general, and particularly scroll compressors, are often disposed in a hermetic shell which defines a chamber within which is disposed a working fluid. A partition within the shell often divides the chamber into a discharge pressure zone and a suction pressure zone. In a low-side arrangement, a scroll assembly is located within the suction pressure zone for compressing the working fluid. Generally, these scroll assemblies incorporate a pair of intermeshed spiral wraps, one or both of which are caused to orbit relative to the other so as to define one or more moving chambers which progressively decrease in size as they travel from an outer suction port towards a center discharge port. An electric motor is normally provided which operates to cause this relative orbital movement.

The partition within the shell allows compressed fluid exiting the center discharge port of the scroll assembly to enter the discharge pressure zone within the shell while simultaneously maintaining the integrity between the discharge pressure zone and the suction pressure zone. This function of the partition is normally accomplished by a seal which interacts with the partition and with the scroll member defining the center discharge port.

The discharge pressure zone of the hermetic shell is normally provided with a discharge fluid port which communicates with a refrigeration circuit or some other type of fluid circuit. In a closed system, the opposite end of the fluid circuit is connected with the suction pressure zone of the hermetic shell using a suction fluid port extending through the shell into the suction pressure zone. Thus, the scroll machine receives the working fluid from the suction pressure zone of the hermetic shell, compresses this working fluid in the one or more moving chambers defined by the scroll assembly, and then discharges the compressed working fluid into the discharge pressure zone of the compressor. The compressed working fluid is directed through the discharge port through the fluid circuit and returns to the suction pressure zone of the hermetic shell through the suction port.

Various methods and devices have been developed which function to attenuate or eliminate any noise generated by the operation of the scroll machine. When the scroll machine is used as a compressor in both refrigeration, as well as air conditioning and heat pump applications, it is particularly advantageous to maintain the lowest operational noise level as possible. Accordingly, the continued development of scroll machines and their fluid systems has been directed to reducing the operational noise levels of these machines while still maintaining the extremely efficient operation for which scroll machines are well known.

The present invention resides in the discovery that attaching a muffler directly to the fixed scroll of the scroll machine provides surprisingly good sound attenuation.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
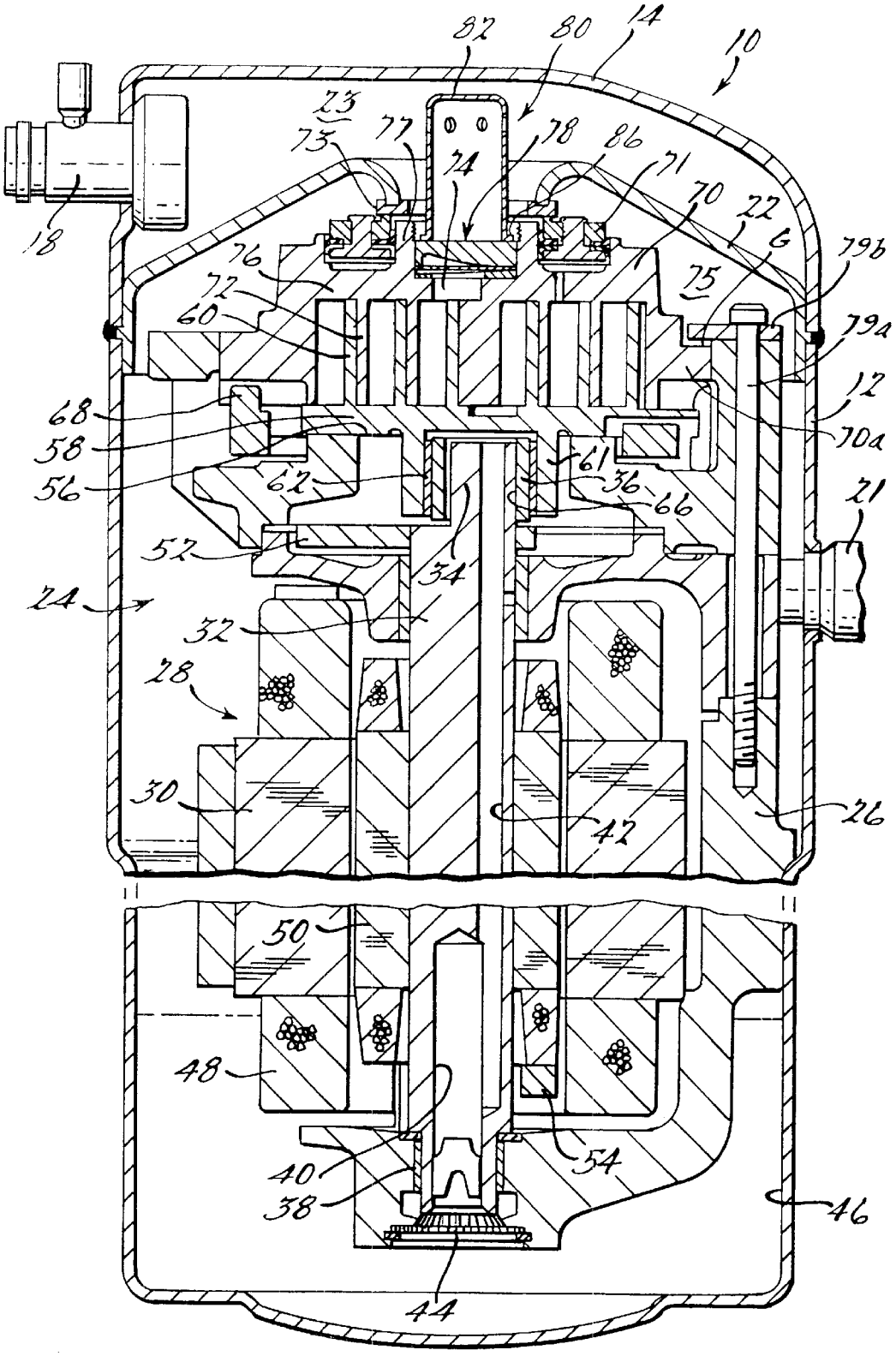
FIG. 1 is a vertical sectional view through the center of a scroll compressor which incorporates a muffler assembly in accordance with the present invention.

While the present invention is suitable for incorporation with many different types of scroll machines, for exemplary purposes, it will be described herein incorporated in a scroll refrigerant compressor of the general structure illustrated in FIG. 1. Referring now to the drawings, and in particular to FIG. 1, a compressor 10 is shown which comprises a generally cylindrical hermetic shell 12 having welded at the upper end thereof a cap 14. Cap 14 is provided with a refrigerant discharge fitting 18 which may have the usual discharge valve therein (not shown). Other major elements affixed to the shell include an inlet fitting 21, a transversely extending partition 22 which is welded about its periphery at the same point that cap 14 is welded to shell 12. A discharge chamber 23 is defined by cap 14 and partition 22. A two-piece main bearing housing 24 and a lower bearing housing 26 having a plurality of radially outwardly extending legs are each secured to the shell 12. The lower bearing housing 26 locates and supports within shell 12 the two-piece main bearing housing 24 and a motor 28 which includes a motor stator 30. A crank shaft 32 having an eccentric crank pin 34 at the upper end thereof is rotatably journaled in a bearing 36 in main bearing housing 24 and a second bearing 38 in lower bearing housing 26. Crank shaft 32 has, at the lower end, a relatively large diameter concentric bore 40 which communicates with a radially outwardly smaller diameter bore 42 extending upwardly therefrom from the top of crankshaft 32. Disposed in bore 40 is a stirrer 44. The lower portion of the interior shell 12 defines an oil sump 46 which is filled with lubricating oil. Stirrer 44 and bore 40 act as a pump to pump lubricating fluid up the crank shaft 32 and into bore 40 and ultimately to all of the various portions of the compressor which require lubrication.

Crank shaft 32 is rotatably driven by electric motor 28 including motor stator 30, windings 48 passing therethrough, and a motor rotor 50 press fitted on crank shaft 32 and having upper and lower counterweights 52 and 54, respectively.

The upper surface of the two-piece main bearing housing 24 is provided with a flat thrust bearing surface 56 on which is disposed an orbiting scroll 58 having the usual spiral vane or wrap 60 on the upper surface thereof. Projecting downwardly from the lower surface of orbiting scroll 58 is a cylindrical hub 61 having a journal bearing 62 therein in which is rotatably disposed a drive bushing 36 having an inner bore 66 in which crank pin 34 is drivingly disposed. Crank pin 34 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An oldham coupling 68 is disposed between orbiting scroll 58 and bearing housing 24. Oldham coupling 68 is keyed to orbiting scroll 58 and a non-orbiting scroll 70 to prevent rotational movement of orbiting scroll member 68. Oldham coupling 58 is preferably of the type disclosed in assignee's U.S. Pat. No. 5,320,506, the disclosure of which is hereby incorporated herein by reference. A floating seal 71 is supported by the non-orbiting scroll 70 and engages a seat portion 73 mounted to the partition 22 for sealingly dividing the intake 75 and discharge 23 chambers.

Non-orbiting scroll member 70 is provided having a wrap 72 positioned in meshing engagement with wrap 60 of orbiting scroll 58. Non-orbiting scroll 70 has a centrally disposed discharge passage 74 defined by a base plate portion 76. Non-orbiting scroll 70 also includes an annular hub portion 77 which surrounds the discharge passage 74. A reed valve assembly 78 is provided in the discharge passage 74.

Figure 2:
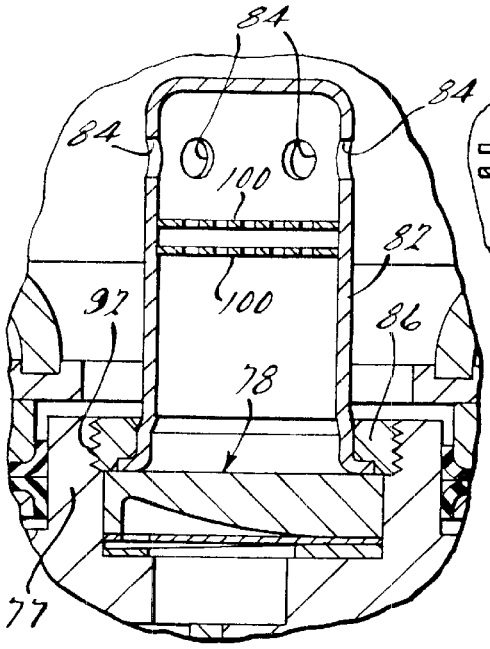
FIG. 2 is a vertical sectional view through the center of a muffler assembly in accordance with a second embodiment of the present invention.
Figure 3:
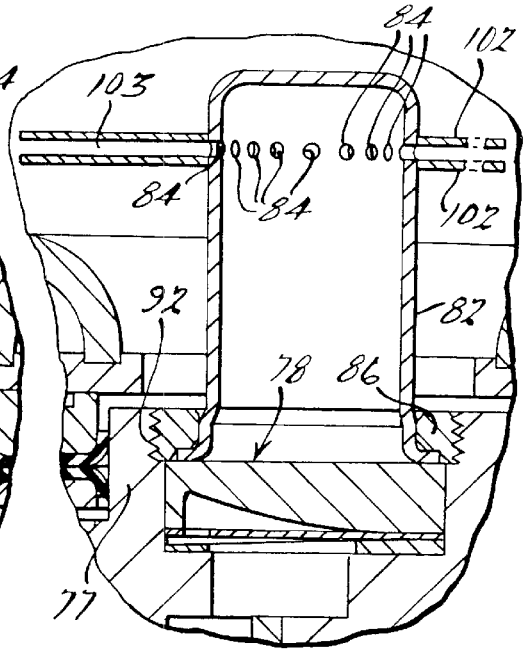
FIG. 3 is a vertical sectional view through the center of a muffler assembly in accordance with a third embodiment of the present invention.
Figure 4:
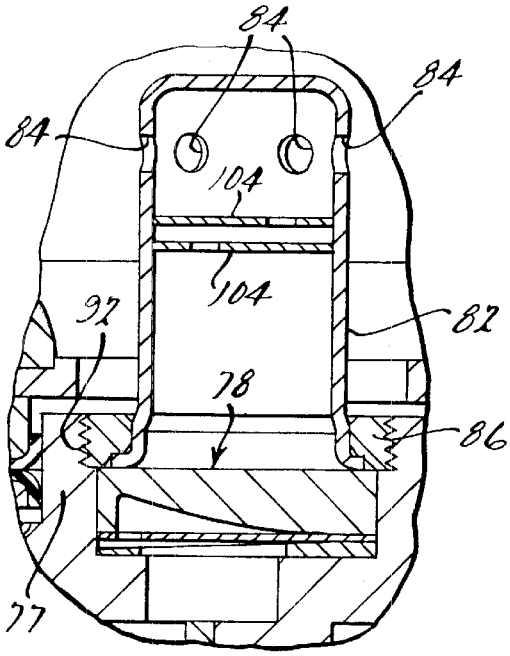
FIG. 4 is a vertical sectional view through the center of a muffler assembly in accordance with a fourth embodiment of the present invention.
Figure 5:
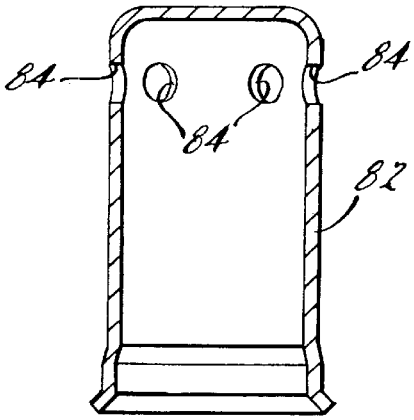
FIG. 5 is a cross-sectional view of the cup-shaped muffler according to the first embodiment of the present invention as shown in FIG. 1.
Figure 6:
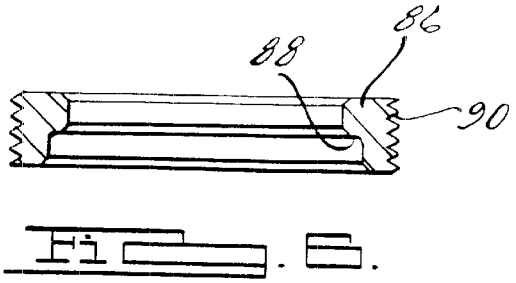
FIG. 6 is a cross-sectional view taken through the center of a nut retainer according to the principles of the present invention as shown in FIGS. 1–4.
Figure 7:
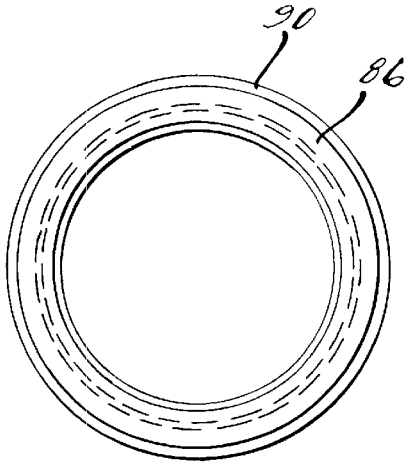
FIG. 7 is a plan view of the nut retainer according to the principles of the present invention as shown in FIGS. 1–4.

A muffler assembly 80 is affixed directly to the non-orbiting scroll member 70. The muffler assembly 80 includes a generally cylindrical cup-shaped muffler 82 which is provided with an annular flange 83 at one end thereof (best shown in FIG. 5) and a plurality of apertures 84 opening radially outwardly in a second end thereof. The apertures 84 are preferably located above the partition 22. The flange portion 83 is engaged by a retainer nut 86 which includes a shoulder 88 (best shown in FIGS. 6 and 7) which engages the flange 83 and an externally threaded portion 90 which threadedly engages internally threaded portion 92 of hub 77, as shown in FIGS. 2–4. The muffler assembly 80 holds the read valve assembly 78 in place, thus, eliminating the need for a read valve nut which is utilized in previous designs. The muffler 82 is connected to the hub 77. It has been discovered that mounting the muffler 82 to the non-orbiting scroll instead of the partition 22 eliminates the transmission of acoustical energy to the partition 22 and compressor shell 12. Furthermore, it is believed the muffler is less susceptible to gas jet-induced vibration due to its stiffer geometry.

With reference to FIG. 2, where like reference numerals designate common elements, a second embodiment of the present invention is shown wherein the muffler 82 is provided with internal screens 100 extending across the diameter of the muffler 82. The internal screens 100 can be soldered to the sidewalls or attached by other known attachment techniques.

With reference to FIG. 3, where like reference numerals designate common elements, a third embodiment of the present invention is shown wherein the muffler 82 is provided with a pair of radially extending discharge plates 102 welded to the outer surface of the muffler 82 to radially discharge the gas to act as a reactive muffler. The muffler 82 includes a plurality of apertures 84 which communicate with a space 103 defined between the pair of discharge plates 102. The compressed gases pass through the muffler 82, apertures 84 between the discharge plates 102 and into the discharge chamber 23.

With reference to FIG. 4, where like reference numerals designate common elements, a fourth embodiment of the present invention is shown wherein the muffler 82 is provided with internal baffles 104 which extend inward from the walls of the muffler. The internal baffles 104 are arranged in a staggered relationship and act as a reactive muffler. The internal baffles 104 can be welded to the walls of the muffler 82 or attached by other known attachment techniques.

Figure 8:
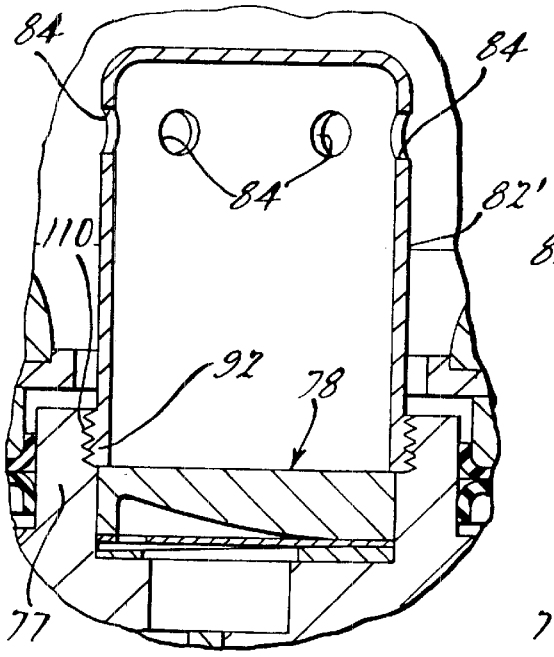
FIG. 8 is a partial cross-sectional view showing the muffler of the present invention being threadedly connected to the hub of the non-orbiting scroll according to a one piece embodiment of the present invention.
Figure 9:
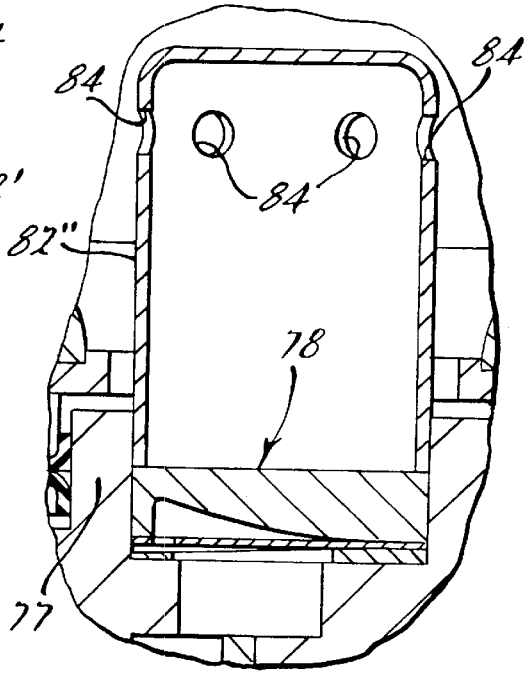
FIG. 9 is a cross-sectional view illustrating the muffler of the present invention being press fit with the hub of the non-orbiting scroll according to a second one-piece embodiment of the present invention.

It should be noted that although the preferred embodiment discloses a retainer nut for securing the muffler to the non-orbiting scroll 70, the muffler 82' can also be provided with a one-piece design wherein external threads 110 are provided on the external surface of the open end of the muffler 82' which engage the internal threads 92 on the hub 77 of the non-orbiting scroll 70, as best shown in FIG. 8. As an alternative, one-piece muffler 82" can be press fit with the hub 77 of the non-orbiting scroll 70, as shown in FIG. 9 or can be attached by other known attachment techniques such as brazing or welding.

Figure 10:
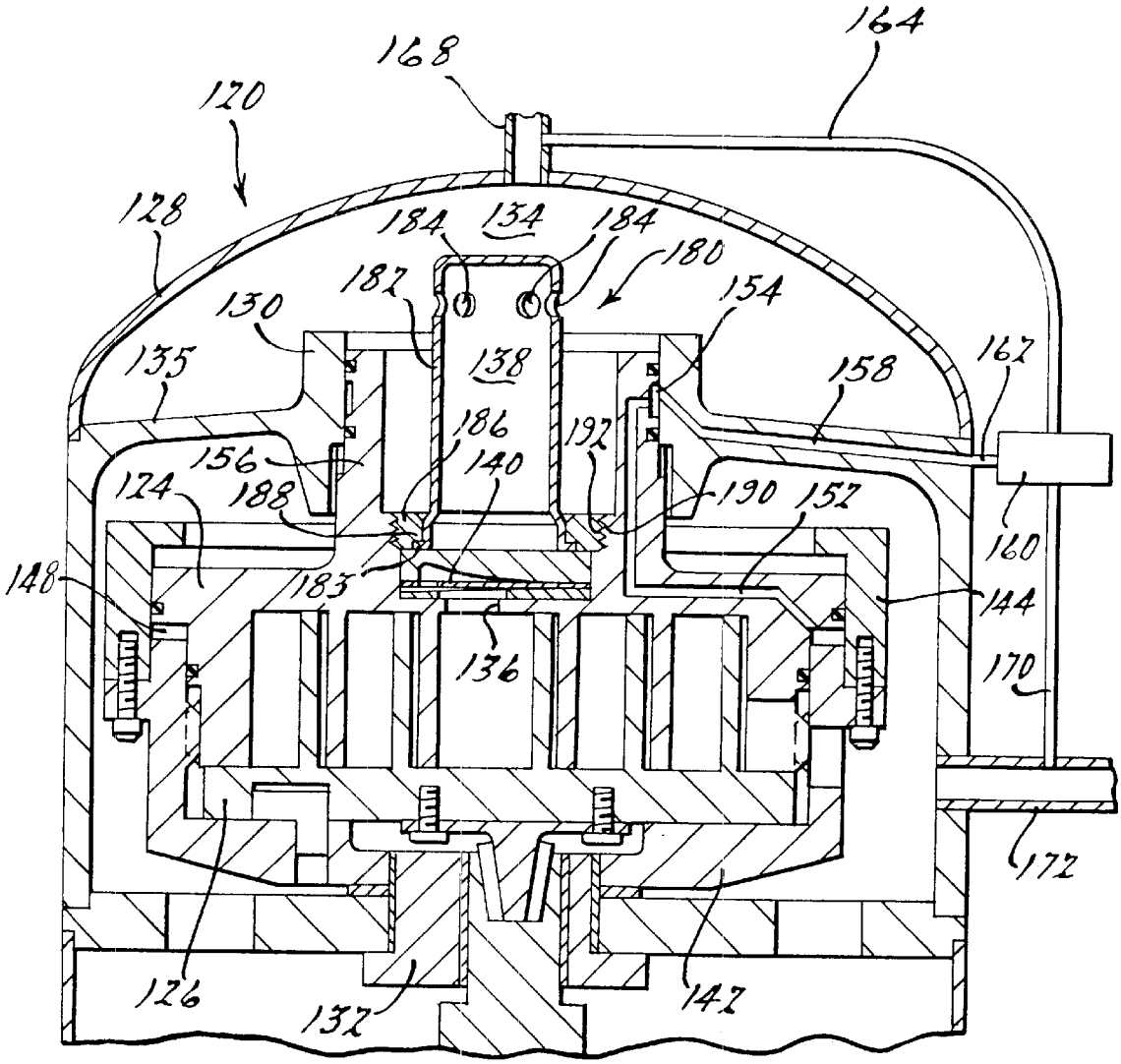
FIG. 10 is a vertical sectional view through the center of a co-rotating scroll compressor which incorporates a muffler assembly in accordance with the present invention.

In addition, the present invention can also be implemented on a co-rotating scroll system as shown in FIG. 10. With reference to FIG. 10, a co-rotating scroll-type compressor 120 is shown in accordance with the present invention. Compressor 120 includes first and second scroll members 124, 126 rotatably supported within an outer shell 128 by upper and lower bearing members 130, 132 axially offset from each other. Upper bearing member 130 is formed in a plate member 135 which also serves to define a discharge chamber 134 into which compressed fluid exiting discharge port 136 in upper scroll is directed via passage 138. A discharge check valve 140 is also provided overlying discharge port 136. Lower scroll member 126 is supported within, and rotatable with, a lower housing 142. An upper housing 144 surrounds upper scroll member 124. The upper housing 144 is secured to the lower housing 142 and cooperates with lower housing 142 and upper scroll member 124 to define a separating chamber 148.

A passage 152 is provided in upper scroll member 124 extending from separating chamber 148 to an annular recess 154 formed in the outer periphery of an upper cylindrical hub portion 156 of upper scroll member 124. Annular recess 154 is in fluid communication with a passage 158 provided in upper bearing member 130 and extending radially outward through plate 135.

A solenoid valve 160 is provided and is controlled by a control module (not shown) in response to system conditions sensed by appropriate sensors (also not shown). Solenoid valve 160 includes a first fluid conduit 162 connected to passage 158, a second fluid line 164 is connected to discharge line 168 and a third fluid line 170 is connected to section line 172. The above-described co-rotating scroll compressor 120 is fully disclosed in commonly assigned U.S. Pat. No. 5,741,120. The co-rotating scroll compressor 120 is provided with a muffler assembly 180 which is affixed directly to upper scroll member 124 according to the principles of the present invention. The muffler assembly 180 includes a generally cylindrical cup-shaped muffler 182 which is provided with an annular flange 183 at one end thereof and a plurality of apertures 184 opening radially outwardly in a second end thereof. The flange portion 183 is engaged by a retainer nut 186 which includes a shoulder 188 which engages the flange 183 and an externally threaded portion 190 which threadedly engages internally threaded portion 192 of hub 156. The muffler assembly 180 holds the reed valve assembly 140 in place, thus, eliminating the need for a reed valve retainer nut.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scroll machine comprising:

a shell;

a first scroll member having a discharge port and a first spiral wrap;

a second scroll member having a second spiral wrap, said first and second spiral wraps being mutually intermeshed, said first scroll member being mounted for axial movement relative to said second scroll member;

a drive mechanism for causing relative orbiting movement between said first and second scroll members, whereby said wraps create at least one enclosed space of progressively changing volume between a peripheral suction zone defined by said scroll members and said discharge port;

a partition defining a discharge chamber and a suction chamber within said shell, said discharge port being in communication with said discharge chamber through a central opening defined by said partition;

a muffler mounted to said first scroll member within said discharge chamber for facilitating release of sound attenuated discharge gas to said discharge chamber.

2. The scroll machine according to claim 1, wherein said muffler assembly includes a generally cylindrical cup shaped muffler defining a plurality of perforations.

3. The scroll machine according to claim 2, wherein said first scroll member includes an internally threaded annular ring portion and said muffler is mounted to said first scroll member by a retainer nut.

4. The scroll machine according to claim 2, wherein said muffler is threadedly connected to said first scroll member.

5. The scroll machine according to claim 1, wherein said muffler is press fit with said first scroll member.

6. The scroll machine according to claim 1, wherein said muffler is welded to said first scroll member.

7. The scroll machine according to claim 1, further comprising a screen disposed within said muffler.

8. The scroll machine according to claim 1, further comprising baffles disposed within said muffler.

9. The scroll machine according to claim 1, further comprising radial discharge muffler plates extending from said muffler.

10. The scroll machine according to claim 1, further comprising a floating seal surrounding said muffler and engageable with said partition for sealingly dividing said discharge chamber and said suction chamber.

* * * * *

UNITED STATES PATENT AND TRADEMARK OFFICE

CERTIFICATE OF CORRECTION

PATENT NO. : 6,422,842 B2 
DATED : July 23, 2002
INVENTOR(S) : John P. Sheridan and Jeffrey W. Hirsch It is certified that error appears in the above-identified patent and that said Letters Patent is hereby corrected as shown below:

Title page,
Item [56], References Cited, U.S. PATENT DOCUMENTS
"4,389,171 A 6/1983 Eber er al." should be -- 4,389,171 A 6/1983 Eber et al. --.
"5,611,674 A 3/1997 Blass et al." should be -- 5,611,674 A 3/1997 Bass et al. --.

Column 3,
Line 38, "oldham" should be -- Oldham --.
Line 41, "68" should be -- 58 --.
Line 42, "Oldham coupling 58" should be -- Oldham coupling 68 --.
Line 47, after "chambers." insert -- The non-orbiting scroll member 70 is designed to be mounted to the bearing housing 24 by means of a plurality of circumferentially spaced bolts 79a extending through stop members 79b and mounting them to the upper surface of the bearing housing 24. Each stop member 79b extends radially inwardly to overlie an upper surface of the flange portion 70a of the non-orbiting scroll member 70 with a gap "G" therebetween so as to cooperate therewith to allow slight limited axial upward movement of non-orbiting scroll member 70 relative to the orbiting scroll 58. --.

Column 4,
Line 1, "read" should be -- reed --.
Line 2, "read" should be -- reed --.

Signed and Sealed this

Fourth Day of February, 2003

JAMES E. ROGAN
*Director of the United States Patent and Trademark Office*